United States Patent [19]

Silva et al.

[11] Patent Number: 4,824,273

[45] Date of Patent: Apr. 25, 1989

[54] ORGANIZATIONAL INSERT AND ALBUM

[76] Inventors: Lucy Silva, 78 Pettit Drive, Etobicoke, Ontario, Canada, M9R 2X2; Maria Moniz, 10 Pettit Drive, Etobicoke, Ontario, Canada, M9R 2W7

[21] Appl. No.: 117,987

[22] Filed: Nov. 9, 1987

[51] Int. Cl.[4] ..... B42F 3/02

[52] U.S. Cl. ..... 402/79; 281/38; 402/8

[58] Field of Search ..... 402/8, 79, 80 R; 281/38

[56] References Cited

U.S. PATENT DOCUMENTS

| | | | |
|---|---|---|---|
| 1,094,923 | 4/1914 | Palmer | 402/8 |
| 4,447,973 | 5/1984 | Wihlke | 402/79 X |
| 4,516,871 | 5/1985 | Leitman | 402/79 |
| 4,704,042 | 11/1987 | Eisen et al. | 281/38 X |

FOREIGN PATENT DOCUMENTS

| | | | |
|---|---|---|---|
| 1260624 | 4/1961 | France | 402/79 |
| 2248693 | 5/1965 | France | 402/79 |

*Primary Examiner*—Paul A. Bell

[57] ABSTRACT

An insert for effective display and storage of information is proposed which is particularly suited for a student's school year. The insert is adapted to be retained in a loose leaf binder, although other arrangements are possible. Each insert includes first and second sections joined along a common edge and movable from a folded condition essentially protecting the stored contents to an extended position which exposes information in certain display areas and allows removal of bulk stored information such as report cards.

20 Claims, 3 Drawing Sheets

ORGANIZATIONAL INSERT AND ALBUM

BACKGROUND OF THE INVENTION

The present invention relates to a binder insert suitable for use in a loose leaf type binder or album where the insert is designed for the display of certain information and the storage of other information. The insert and album have particular application in the recording, displaying and storing of information associated with a student's school years.

Various arrangements have been proposed for maintaining, in an organized fashion, information received during a student's school year, such information including report cards, class photos, team photos, athletic badges and scholastic badges or crests, etc. According to one prior art structure, an envelope type arrangement is presented, one envelope for each school year, where report cards and other such items may be placed within the envelope and the exterior of the envelope has been printed to allow the completion of certain information such as school year, homeroom teacher, achievements during the year and such things as noteworthy events. Systems of this type suffer in that the information, in particular pictures, etc., are stored within the envelope and must removed for observation.

There remains a need to provide a simple system which effectively displays the stored information to allow convenient review thereof without removal as well as a separate section for collected storage of other items. The system should protect the displayed and stored information and should also allow the user to record various information in a convenient manner, with this information also being available as a summary which can be conveniently reviewed. There remains a need for a simple, convenient system for recording particular information which allows display of at least some of the information and storage of other information, with all information both displayed and stored being protected from damage.

SUMMARY OF THE INVENTION

A loose leaf binder insert according to the present invention comprises first and second rectangular like sections joined along a common edge, with each section being movable about the edge from a folded orientation to an extended orientation. The first section has a pocket extending generally substantially across the first section, adapted to receive and store records. The pocket terminates adjacent a lower edge of the first section and has an upper edge terminating substantially below a top edge of the first section. The second section is of a double thickness, sealed about the sides and bottom edges, with the top edge open to allow insertion of material therein. At least some of the second section is of a transparent sheet material to display the material stored therein.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
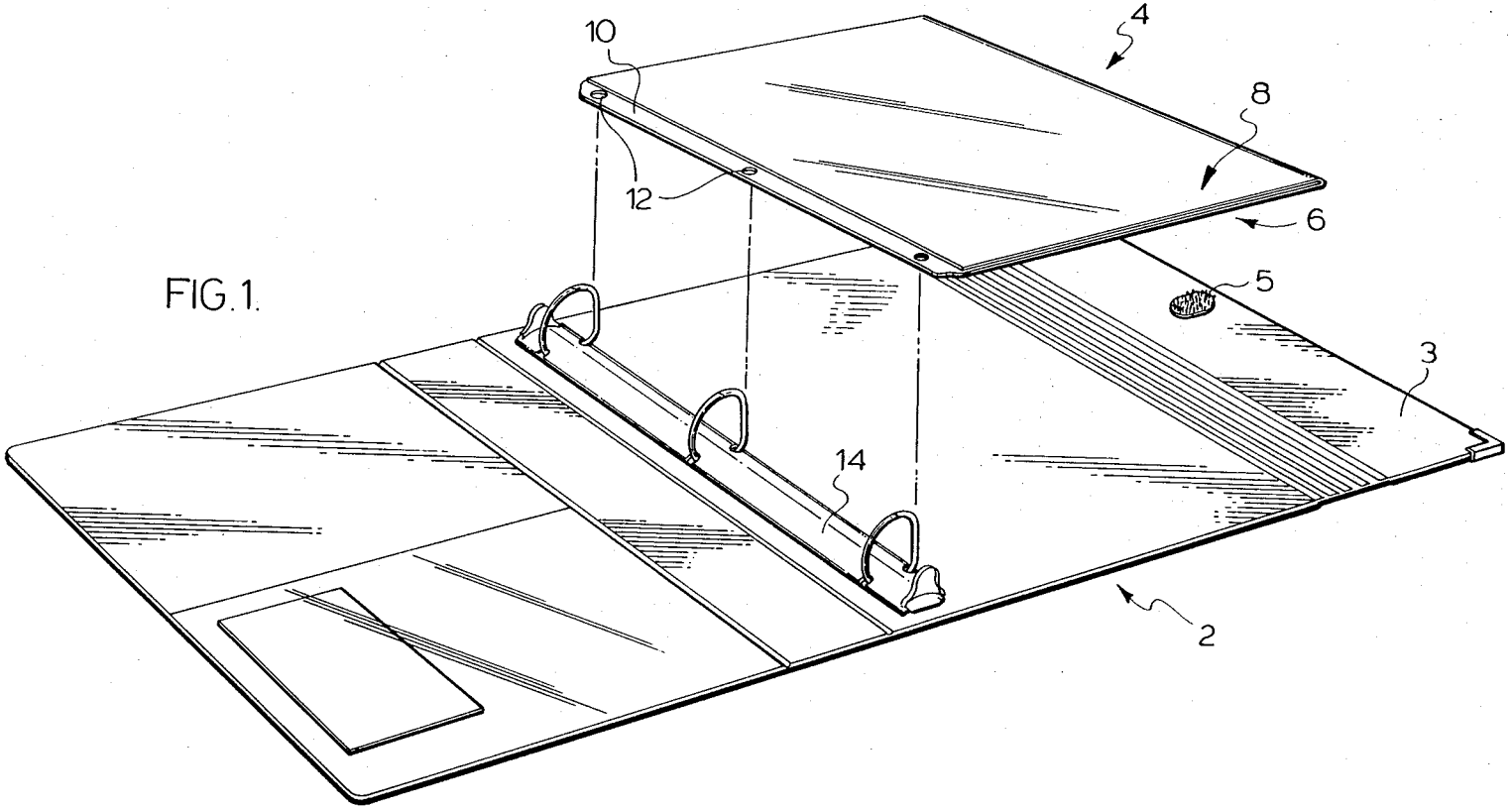
FIG. 1 is a perspective view of the binder insert and an associated binder for storing of the inserts.
Figure 6:
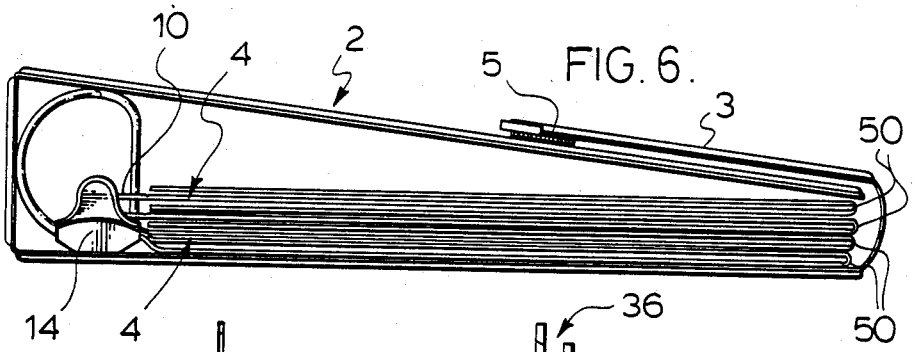
FIG. 6 is a sectional view through the binder of FIG. 1 having several inserts placed therein.

The loose leaf binder 2 generally shown in FIG. 1 is designed to receive a number of loose leaf binder inserts 4 therewithin and retain them within the binder in the conventional manner using a retaining portion 14 with rings for engagement with holes 12 of the insert 4. The binder preferably has a closing flap 3 having a velcro fastener 5 on the interior surface thereof which cooperates with a similar manner on the front face of the binder. This closing aspect is shown in FIG. 6.

The insert 4 is generally of rectangular shape and includes a first section 6, a second section 8 and a securing region 10 associated with the first section 6. The insert as shown in FIGS. 1 and 2 is in the folded orientation, whereas the insert of FIG. 3 is in the extended orientation.

Figures 2, 3:
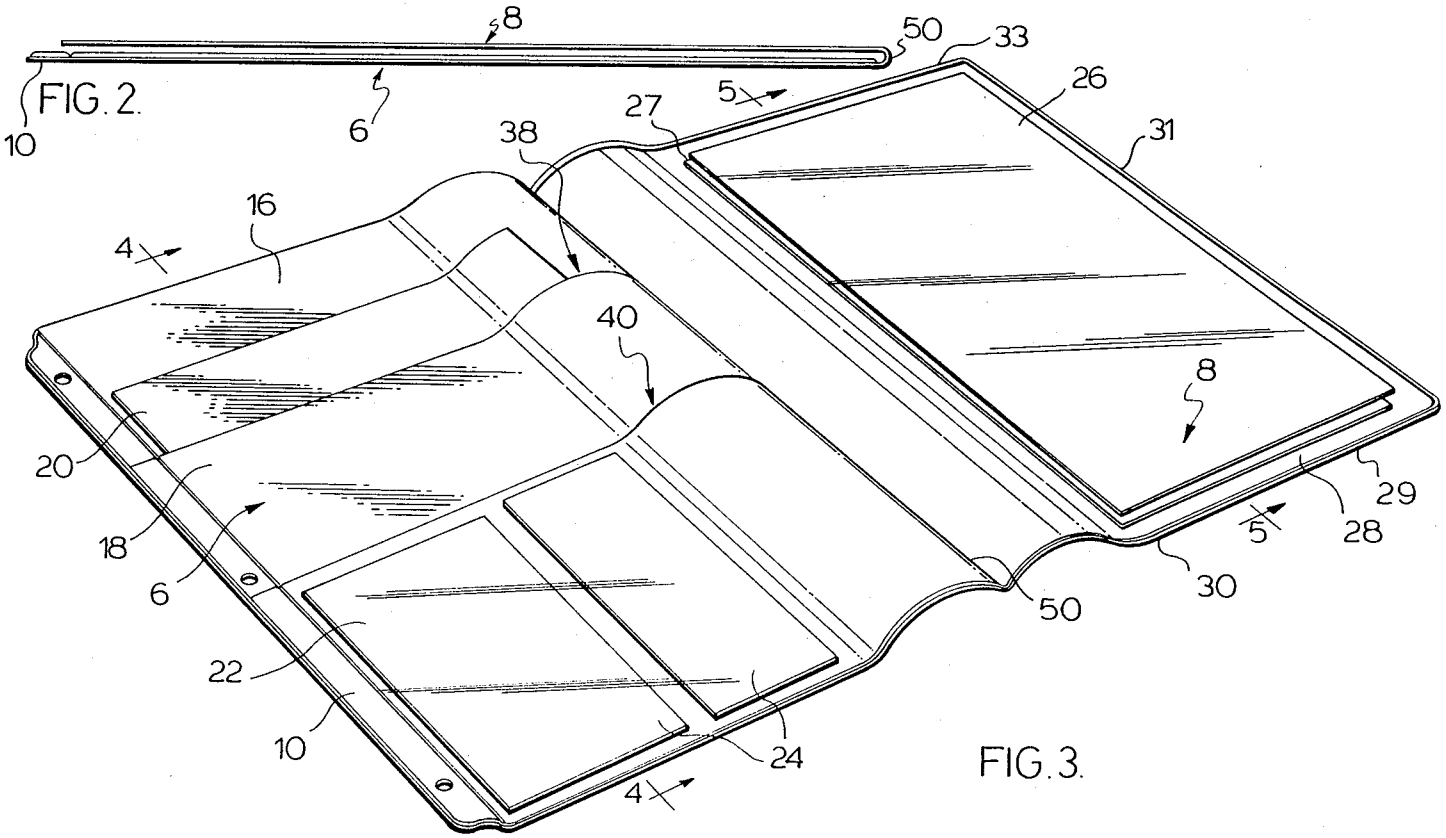
FIG. 2 is a sectional view through a folded binder insert.
FIG. 3 is a perspective view of the binder insert in an extended orientation.
Figure 4:
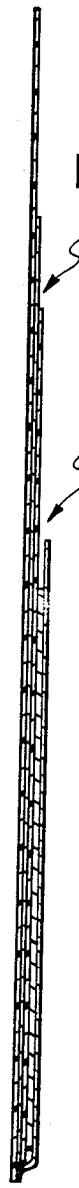
FIG. 4 is a sectional view taken along line 4—4 of FIG. 3.
Figure 5:
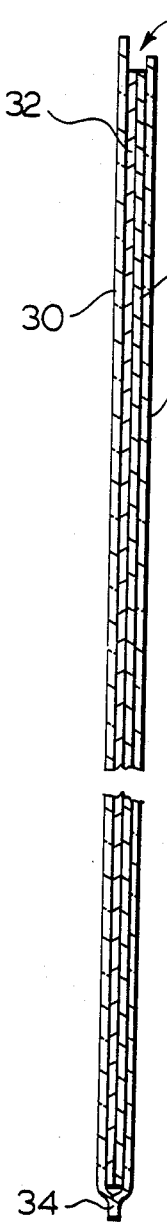
FIG. 5 is a sectional view taken along line 5—5 of FIG. 3.

Turning to FIG. 3, the first section 6, in addition to having the securing region 10, has a back sheet 16, a first overlying partial sheet 18 extending to the lower edge of the section 6, and a transparent overlying sheet 22 of reduced size relative to sheet 18. Both sheet 18 and 22 extend across the first section 6 and define a first pocket 38 shown in FIG. 4 and a second pocket 40. Pocket 38 is adapted to store such information as report cards, etc. which are indicated as 20 and would be removed from pocket 38 for observation. In light of this, the pocket of additional depth defined by sheet 18 in cooperation with back sheet 16 is used to assure this information is retained within the insert. In contrast, pocket 40 is adapted for the display of certain information such as class photos or individual photos which may reflect the student's participation in a band or athletic team. These pictures or capacity of pocket 40 is such that the pictures would be of a reduced size, certainly sufficient to protectively display at least two pictures of the 3″×5″ type size. The first section 6 is joined to the second section 8 along the common edge 50 and this edge is defined by the various sheets making up both the first and second sections.

The second section 8 is preferably transparent, having an interior sheet 28 and a back sheet 30 of approximately equal size, heat sealed together along the common edge 50, along the bottom edge 29 and the side edge 31. This section is of approximately the same size as the first section minus the retaining portion 50 and as such, is capable of receiving larger class or team photos. The sheets 28 and 29 are separable along the top edge 33 to allow insertion of these photos, generally indicated in broken lines as 26. In addition to the photo generally indicated as 26, an insert 27 is provided within the second section 8 and is visible to the exterior of the insert when the insert is in the folded orientation generally shown in 2. Insert 27 is preferably of a white sheet material having various indicia thereon such as the school year, homeroom teacher, achievements throughout the year and noteworthy events. This insert 27 can be removed from the insert and quickly completed by the parent or student and as such, provides a record of information which is important but not represented by the photos or report cards. In addition, this insert 27 may have provision for a small picture of the student and as such, provides a summary for the contents of the insert when used to display and retain information collected through the school year.

As can be appreciated, the common edge 50, which adjacent the lower edge and to the first section side of the common edge 50, is of a triple thickness of sheet material made up of the transparent sheet 22, the non-transparent sheet 18 and the non-transparent backing sheet 16, and to the opposite side of the common edge is of a double thickness made up of sheet materials 28 and 30. In contrast, above the pocket 40, the common edge is only of a double thickness of sheet material, whereas above pocket 38 the edge is of a single thickness on the first section side and a double thickness on the second section side. This additional thickness of material adjacent the lower edge of the insert results in a common edge which is quite stiff and effectively biases the insert to the folded orientation shown in FIG. 2.

In reviewing the structure of FIG. 6, it can be seen that a number of inserts 4 are retained within the binder 2 and all inserts are in the folded orientation. The common edge 50 is located at the exterior of the binder 2 and serves as a stiffener to the insert to ensure the contents of the insert are not subject to damage or folding. For example, any forces exerted on the common edge 50 of the insert are distributed along the edge and do not result in localized creasing or folding. Furthermore, this edge serves to assure that the first and second sections maintain alignment and as such, maintain the orientation which will maintain the contents of the insert either in the various pockets or in the display sections.

The system presently disclosed allows for the recording of information on the insert 27 in a summary type form visible through the second section 8 when placed in the folded orientation of the insert 4. Preferably this insert includes a region for receiving a photograph representative of the student at this point in time. Other information such as the grade, the age, school name, homeroom teacher and achievements or noteworthy events are afforded space for recording. In this way, insert 27 may be removed, quickly completed and returned to second section 8 to act as a summary of the school year and a summary of the contents of the insert. Additional information regarding the year can be found when the insert is placed in the extended orientation where additional photos can be provided, either in pocket 40 and/or the interior of the second section. As such, these photos will be visible when the insert in the extended orientation.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A loose-leaf binder insert comprising a first generally rectangular in shape section and a second section of similar shape, said first and second sections being integrally connected along one straight edge and defining a fold line therebetween, with said sections being movable about said fold line from an extended to a folded orientation, said first section at an edge opposed to said fold line including a securing region for fastening of said insert in a binder;

said first section comprising a full back layer and an overlying middle layer which, in combination with said back layer, defines a first pocket for storage of material that requires removal to review, said second section comprising two opposed transparent layers defining a pocket therebetween which is open at the top and closed on the sides and bottom for display of material stored therein, and wherein said back layer of said first section is of a plastic sheet material and said middle layer terminates at an upper edge substantially spaced from an upper edge of said back layer, and wherein said first section further includes a transparent sheet overlying said middle layer and defining therewith a display pocket which is open along an edge thereof to insert material, said display pocket overlying said first pocket.

2. A loose-leaf binder insert as claimed in claim 1, wherein said back layer and said middle layer of said first section are of a non-transparent vinyl.

3. A loose-leaf binder insert as claimed in claim 2, wherein said fold line at the lower portion thereof is of greater thickness and stiffness relative to the upper portion of the fold line.

4. A loose-leaf binder insert as claimed in claim 3, wherein said fold line is a heat seal line defining a portion of the sides of said pockets, said heat seal being shaped to urge said first and second sections to an overlapping condition.

5. A loose-leaf binder insert as claimed in claim 3, wherein said layers of said first section extend into said securing region to reinforce said securing region.

6. A loose-leaf binder insert as claimed in claim 3, including a paper insert received in said pocket of said second section and including indicia thereon visible when said first and second sections are positioned in an overlying relationship.

7. A loose-leaf binder insert as claimed in claim 3, wherein said fold line is reinforced by said layers of said pockets to define a reinforced edge.

8. A loose leaf binder as claimed in claim 1, wherein said display pocket extends across at least essentially the width of said first section and of a height of about 5 inches.

9. A loose leaf type binder insert comprising first and second rectangular like sections joined along a common edge and movable about said edge from a folded orientation to an extend orientation, said first section having two pockets extending generally substantially across said first section with one of said pockets atop the other pocket, said pockets both terminating adjacent a lower edge of said first section and both of said pockets having an upper edge terminating substantially below a top edge of said first section, said second section being of a double thickness sealed about the common edge, an edge opposite said common edge and a bottom edge with a top edge open to allow insertion of material therein, and wherein at least some of said pockets and said second section are of a transparent sheet material to allow viewing of stored material therethrough.

10. A loose leaf binder insert as claimed in claim 9, wherein said second section is made of a transparent plastic sheet material.

11. A loose leaf binder insert as claimed in claim 10, wherein said overlapping second pocket of said first section is partially defined by an outer transparent sheet.

12. A loose leaf binder insert as claimed in claim 11, wherein said first section has a non-transparent full back sheet and a non-transparent sheet which, in combination with said full back sheet, defines an underlying pocket of said overlapping pockets.

13. A loose leaf binder insert as claimed in claim 12, wherein said common edge is of greater thickness adjacent the lower edge of the insert.

14. A loose leaf binder insert as claimed in claim 13, wherein said common edge is of greatest thickness along the portion of said common edge adjacent said second pocket.

15. A loose leaf binder insert as claimed in claim 12, wherein said second section includes a similar sized paper insert having various indicia thereon visible through said second section.

16. A loose leaf binder insert as claimed in claim 15, wherein said insert is printed on one side thereof and disposed such that the indicia thereon is visible through said pocket when said insert is said folded insertion.

17. A system for retaining and displaying annual school year information comprising a binder having loose leaf retaining means generally centrally disposed and a plurality of separate laminated plastic sheet inserts retained in said binder by said retaining means, each insert having a securing portion at one side which cooperates with said retaining means to retain said inserts in said binder, each insert further including a first section and a second section joined along a common edge and movable about said edge from a folded condition with said sections being in a stacked configuration to an extended position with said sections side by side, said first section having two pockets located interior to said insert when in the folded orientation, with at least one of said pockets extending at least substantially across said first section and the other pocket being smaller in size for display of information therethrough when said insert is in the extended position; and wherein said second section includes display areas on both sides thereof, said section including transparent regions associated with said display areas whereby information stored within said second section is visible through said transparent regions.

18. A system as claimed in claim 17, wherein said second section includes two essentially transparent plastic sheets joined on side and bottom edges to form a pocket open at a top edge of said section, said second section further including a paper insert having titles thereon associated with a student's school year and areas associated with each title to allow completion by writing information on said insert, said insert being orientated when received in second pocket to expose said titles through said pocket when said insert is in the folded condition.

19. A system as claimed in claim 18, wherein said first section, other than said display pocket, are made of a non-transparent plastic sheet material.

20. A system as claimed in claim 18, wherein said common edge of each insert acts as a reinforcing rib which serves to distribute loads applied to said rib therealong and reduce localized deformation of said insert, thereby protecting the contents of said insert.

* * * * *